US010260341B2

(12) United States Patent
Kammerer et al.

(10) Patent No.: US 10,260,341 B2
(45) **Date of Patent: *Apr. 16, 2019**

(54) PICK, IN PARTICULAR A ROUND SHAFT PICK

(71) Applicant: Betek GmbH & Co. KG, Aichhalden (DE)

(72) Inventors: Karl Kammerer, Fluorn-Winzeln (DE); Heiko Friederichs, Aichhalden-Roetenberg (DE)

(73) Assignee: Betek GmbH & Co. KG, Aichhalden (DE)

( * ) Notice: Subject to any disclaimer, the term of this patent is extended or adjusted under 35 U.S.C. 154(b) by 11 days.

This patent is subject to a terminal disclaimer.

(21) Appl. No.: 15/273,794

(22) Filed: Sep. 23, 2016

(65) Prior Publication Data

US 2017/0030191 A1 Feb. 2, 2017

Related U.S. Application Data

(63) Continuation of application No. PCT/EP2015/055263, filed on Mar. 13, 2015.

(30) Foreign Application Priority Data

Mar. 24, 2014 (DE) ..... 10 2014 104 040

(51) Int. Cl.
*E21C 35/19* (2006.01)
*E21C 35/197* (2006.01)

(52) U.S. Cl.
CPC ..... *E21C 35/19* (2013.01); *E21C 35/197* (2013.01)

(58) Field of Classification Search
CPC ... E21C 35/19; E21C 35/197; E21C 2035/191
(Continued)

(56) References Cited

U.S. PATENT DOCUMENTS 5,725,283 A * 3/1998 O'Neill ..... E21C 35/197 299/104
6,113,195 A 9/2000 Mercier et al.
(Continued)

FOREIGN PATENT DOCUMENTS

DE 37 01 905 C1 9/1988
EP 1 427 913 B1 2/2006
(Continued)

OTHER PUBLICATIONS

International Search Report and Written Opinion (Application No. PCT/EP2015/055263) dated Aug. 25, 2015.

*Primary Examiner* — Janine M Kreck
*Assistant Examiner* — Michael A Goodwin
(74) *Attorney, Agent, or Firm* — Burr & Brown, PLLC

(57) ABSTRACT

The present invention relates to a pick, in particular, a round shaft pick, having a pick head and a pick shaft, having a support element which has a centring lug on the underside thereof, wherein the centring lug has a centring surface which extends inclined with respect to the central longitudinal axis of the pick and merges into a seat surface. To this end circumferential channel according to the present invention is disposed in the transition region from the centring surface to the seat surface and the depth of the channel relative to the seat surface is greater than or equal to 0.3 mm. The pick has an optimised rotatability and thus a low wear.

16 Claims, 2 Drawing Sheets

(58) Field of Classification Search
USPC ..... 299/104, 106, 107, 110
See application file for complete search history.

(56) References Cited

U.S. PATENT DOCUMENTS

| | | | | |
|---|---|---|---|---|
| 8,099,847 | B2 * | 1/2012 | Hahn | E21C 35/197 29/239 |
| 2012/0326488 | A1 | 12/2012 | Lehnert et al. | |
| 2015/0369044 | A1 | 12/2015 | Lehnert et al. | |

FOREIGN PATENT DOCUMENTS

| | | | |
|---|---|---|---|
| EP | 2 639 402 | A2 | 9/2013 |
| WO | 03/023189 | A1 | 3/2003 |

* cited by examiner

PICK, IN PARTICULAR A ROUND SHAFT PICK

CROSS REFERENCE TO RELATED APPLICATIONS

This application is a continuation of International Application No. PCT/EP2015/055263 filed Mar. 13, 2015, which designated the United States, and claims the benefit under 35 USC § 119(a)-(d) of German Application No. 10 2014 104 040.6 filed Mar. 24, 2014, the entireties of which are incorporated herein by reference.

FIELD OF THE INVENTION

The present invention relates to a pick, in particular, a round shaft pick, having a pick head and a pick shaft, having a support element which comprises a protruding centering attachment on its bottom surface and wherein the centering attachment comprises a centering surface which extends at an angle with respect to the center longitudinal axis of the pick and merges into a seating surface.

BACKGROUND OF THE INVENTION

A pick of this type is disclosed in DE 37 01 905 C1. In this case, the fastening sleeve is realized as a clamping sleeve which is formed from a resilient elastic material, for example, sheet steel. It comprises a longitudinal slot which is delimited by sleeve edges. The fastening sleeve diameter is able to be varied by means of the longitudinal slot, it being possible to move the sleeve edges toward one another (small diameter) or are they are spaced further from one another (large sleeve diameter). Different clamping states can be achieved in this way. The support element which is realized as an anti-wear disk is pulled onto the fastening sleeve. The support element comprises a circular cross section and is penetrated by a bore. In this case, the bore is dimensioned such that the fastening sleeve is held in a pre-clamping state with a reduced outside diameter compared to its relaxed state. The outside diameter generated in this manner is chosen in such a manner that the clamping sleeve is able to be slid into a pick receiving means of a pick holder with a small amount or no expenditure of force. The insertion movement is delimited by means of the support element. As the pick shaft is inserted further into the bore, the support element is moved into a region of the pick shaft that is not encompassed by the clamping sleeve. The fastening sleeve then springs open radially and is clamped in the bore of the pick holder. In this way the round shaft pick is held so as to be axially captive, but freely rotatable in the circumferential direction. To dismantle the pick, it is driven out of the pick receiving means by means of a mandrel which acts upon the back of the pick shaft.

EP 1 427 913 B1 discloses a disk for a rotatable cutting bit having: a front side and a rear side, the front side having several ribs and the rear side having several recesses. The rear side further comprises a beveled edge which is arranged circumferentially with respect to a central bore. The recesses are spaced uniformly from one another and from the beveled edge. The beveled edge is angled sharply into the surface of the rear side. The sharp angle can result in the disk not resting flatly on the holding block arranged below it, which leads to increased abrasion of the disk and of the holding block. In addition, the sharp transition can result in the disk becoming jammed and its rotation prevented, as a result of which one-sided wear is produced on the cutting bit.

EP 2 639 402 A2 consequently proposes a bit, in particular, a round shaft bit, having a bit head and a bit shaft, a fastening sleeve being held in the region of the bit shaft, and having a support element which comprises a guide region, the support element comprising a protruding centering attachment on its bottom surface. The centering attachment comprises a centering surface, which extends at an angle to the center longitudinal axis of the bit and merges into a circumferential support surface, which extends radially to the center longitudinal axis by means of a set-back recess. The recess, in this case, is worked into the centering surface and the support surface such that in the mounted state it receives an oppositely situated sharp edge of the bit holder. The support element accordingly, within the framework of the production tolerances, does not rest on the edge of the bit holder, as a result of which a flat supporting of the support element on the provided support surface of the bit holder is ensured. As a result, the abrasion of the support element and of the bit holder is reduced and at the same time the free rotation of the disk is improved. However, there is an edge in the transition from the centering surface to the recess. The edge provides a continuity jump with a negative effect on the rotation and consequently on wear behavior. In addition, as a result of the recess molded both in the support surface and in the centering surface, waste material is able to pass into the region of the bit shaft and obstruct the rotation of the bit there and increase the amount of wear. A further disadvantage is produced by the fact that as a result of the recess, the support surface between the centering surface of the support element and the corresponding surface of the centering receiving means of the bit holder is made smaller, as a result of which the surface pressure on the remaining surface increases under the same load. This also leads to increased wear in the region with the support element at the same time being guided less at the side.

SUMMARY OF THE INVENTION

It is consequently the object of the present invention to create a pick of the type mentioned in the introduction with optimized wear behavior.

The object of the present invention is achieved in that a circumferential groove is arranged in the transition region from the centering surface to the seating surface and that the depth of the groove in relation to the seating surface is greater than or equal to 0.3 mm.

In the mounting position, the support element rests with its seating surface on a wear surface of a pick holder. When new, the groove releases the associated edge region of the pick holder, which leads to the support element being supported in a flat manner and to free rotatability. As a result of stress during use, the support element and the pick holder wear in the region of the seating surface or the wear surface. In this case, a circumferential bead is generated on the pick holder in the region of the groove. The bead is generated as a result of the support element wearing away the wear surface of the pick holder as a consequence of rotation of the pick and of the support element. By way of the bead, the support element receives additional lateral guiding, as a result of which, for example, jamming of the support element and consequently one-sided and consequently quick wearing of the support element and of the pick can be reliably avoided. As a result of the groove and of the region of the pick holder worked into the groove, a labyrinth-like sealing region is formed which reduces the ingress of waste material into the region of the pick shaft. Consequently, the wear is even reduced in the region and the free rotatability of the pick is improved. The depth of the groove of at least 0.3 mm ensures reliable lateral guiding as well as a noticeable reduction in the entry of waste material.

The pick holder should be harder than the support element in the region of the wear surface. As a result, the pick holder can weather multiple wear cycles of the pick. If a pick is worn, a new pick can be combined with the pick holder. The groove of the new pick then receives the bead, the ideal supporting of the support element on the wear surface of the pick holder remaining unchanged.

Corresponding to a preferred development variant of the present invention, it can be provided that the centering surface merges tangentially into the top surface of the groove. The centering surface consequently merges seamlessly into the surface formed by the groove. As a result, there is no continuity jump, which has a positive effect on the rotating behavior and consequently on the wear of the pick and of the support element. As a result of the continuous transition from the centering surface into the surface of the groove, the surface for receiving laterally acting forces is enlarged, which leads to lower surface pressure and consequently to reduced wear in the region of the centering receiving means of the pick holder.

Good lateral guiding of the support element is produced as a result of the groove comprising a depth of between 0.3 mm and 2 mm and preferably of between 0.5 mm and 1.5 mm, in relation to the seating surface. If the depth of the groove is chosen to be less than 0.3 mm, a sufficiently marked bead, which leads to the support elements being laterally stabilized, is not produced. Groove depths of up to 2 mm produce a good sealing effect (labyrinth seal) between the bead and the groove. If the dimensional range of between 0.5 mm and 1.5 mm is chosen, a good combined effect is produced between sealing and lateral guiding.

The groove, proceeding from the seating surface, is worked into the support element. As a result, the material thickness of the support element is reduced in the region of the groove by the depth thereof. In order nevertheless to obtain sufficient stability and longevity of the support element, it can be provided that the ratio of the thickness of the part of the support element receiving the groove to the depth of the groove is at least 2 to 1 and/or that the material thickness between the groove and a support surface located opposite the seating surface is at least 2 mm.

Uniform abrasion of the pick holder over the entire wear surface without forming an edge obstructing the free rotation on the outside periphery of the wear surface can be achieved as a result of the support element comprising a diameter of between 38 mm and 49 mm and in a preferred manner of between 40 mm and 48 mm. The support element consequently ends at its outside periphery at least approximately with the wear surface of the pick holder.

The range between 38 mm and 49 mm, in this case, is to be preferred, in particular, for use in street milling machines. In this case, a diameter of 38 mm forms a lower boundary which ensures sufficient carrying capacity of the support element. 49 mm provides an upper boundary where the friction between pick holder, support element and pick is such that optimized rotating characteristics of the pick are possible. Optimized rotating characteristics are present when free rotation of the pick is possible in order to avoid one-sided wear of the pick, at the same time, however, avoiding rotating the pick too strongly which leads to increased wear on a support surface of the pick, on the support element and on the wear surface of the pick holder.

A diameter range of between 40 mm and 48 mm is to be provided in a preferred manner for large milling machines, the range forming an optimum between sufficient carrying capacity of the support element and rotatability of the pick.

A particularly preferred variant of the present invention is such that the groove comprises a rounded, in particular, circular contour and in that the radius of the contour lies within a range of between 0.5 mm and 6 mm and in a particularly preferred manner is at a radius of 1.5 mm. In addition, it can be provided that the top surface of the groove is carried over a rounding portion into the top surface of the seating surface. As a result of the circular contour or the rounded transition from the top surface of the groove into the top surface of the seating surface, edges are avoided in the region between the seating surface and the wear surface. This leads to improved rotatability of the support element and consequently to reduced wear of the pick. It is ensured from a lower radius of the groove of 0.5 mm that the bead is not realized in too sharp-edged a manner in order to achieve good rotatability of the support element. In this case, sufficient lateral stability of the support element is achieved up to a radius of 6 mm.

The rotatability, in this case, can be improved, in particular, as a result of the rounding portion being formed by a circular arc portion with a second radius within a range of between 0.2 mm and 25 mm and in a particularly preferred manner is 1.0 mm.

Also in the region of the transition from the groove to the seating surface, it is advantageous with reference to the rotatability of the support element and of the pick when there are not any sharp edges. Consequently, it can be provided that the rounding portion merges tangentially into the seating surface.

Reliable guiding of the support element on the pick shaft can be achieved as a result of the support element forming a guide region which is formed by a bore which extends in the direction of the center longitudinal axis of the pick, that the guide region is merged into the centering surface by means of a circumferential web and that the web comprises a width within a range of between 0.1 mm and 2.0 mm and in a particularly preferred manner is 0.5 mm. The guide region, in this case, is located opposite a cylindrically formed centering portion of the pick shaft in the mounted state. In this case, the diameter of the centering portion is chosen in such a manner that it is able to move with a predetermined clearance in the bore forming the guide region. The rotating bearing arrangement formed in this manner ensures free rotatability between the guide region of the support element and the centering portion of the pick shaft with a simultaneously small lateral offset transversely with respect to the center longitudinal axis of the pick. As both the guide region and the centering portion can be realized as continuous cylindrical surfaces with constant diameters, the edges and transitions obstructing the free rotatability can be avoided. In this case, the guide extends over the complete length of the guide region and of the centering portion, which results in a high mechanical load capacity in the region. The material thickness of the centering attachment in the transition to the guide region avoids being too small and consequently sensitive to mechanical damage as a result of the web. At the same time, the width of the web must be chosen to be as small as possible in order to obtain centering surfaces and guide regions that are as large as possible under the given spatial conditions and the preferred angle of the centering surface.

BRIEF DESCRIPTION OF THE DRAWINGS

The present invention is explained in more detail below by way of an exemplary embodiment shown the drawings, in which:

in FIG. 1;

DETAILED DESCRIPTION OF THE INVENTION

Figure 1:
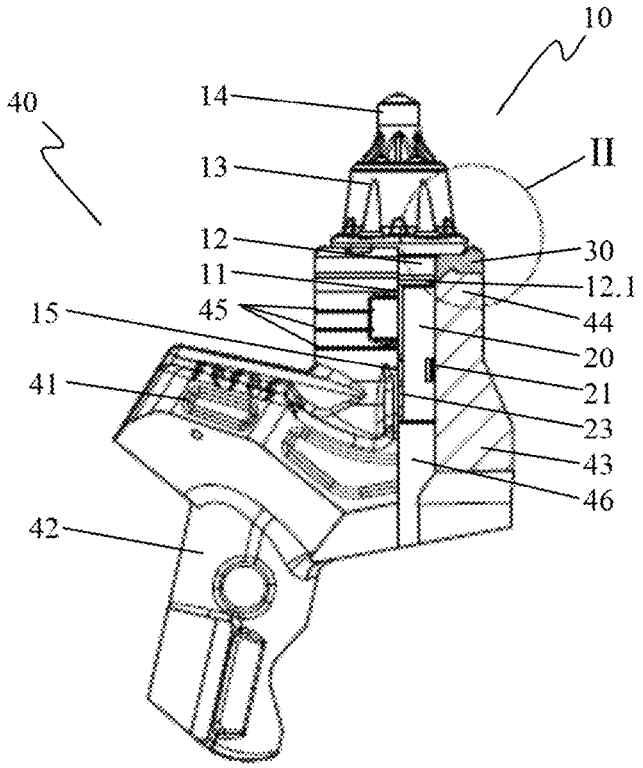
FIG. 1 shows a side view of a pick in its mounting position on a pick holder.

FIG. 1 shows a side view of a pick 10 in its mounting position on a pick holder 40, a sectional representation of part of the pick holder 40 being shown. The pick 10 is realized as a round shaft pick. It comprises a pick head 13 which merges into a pick tip 14, consisting of hard material, for example, hard metal. To this end, a bowl, into which the pick tip 14 is soldered, is worked into the pick head 13 on the end. On the side situated opposite the pick tip 14, the pick head 13 merges into a cylindrical centering portion 12 which, after a tapering region 12.1, merges into a cylindrical pick shaft 11. The pick head can also merge directly into the pick shaft 11 if the tapering region is dispensed with. The pick shaft 11 in the representation is predominantly concealed by a holding attachment 43 of the pick holder 40 as well as by a fastening sleeve 20. A circumferential groove 15 is inserted into the pick shaft 11. The pick 10, with its pick shaft 11, its pick head 13 and its pick tip 14 is realized so as to be rotationally-symmetrical with respect to the center longitudinal axis which extends through the pick tip 14. The fastening sleeve 20 is arranged in the region of the pick shaft 11. It is produced from a flat material, for example, steel plate. In this case, holding elements 21 are developed from the flat material and are pressed out into the region surrounded by the fastening sleeve 20. The holding elements 21, in this case, are cut free along two edges which extend in the circumferential direction of the fastening sleeve 20. The fastening sleeve 20 is rolled-up in such a manner that a circular cross section is produced leaving a clamping slot 23. The holding elements 21 engage in the groove 15 of the pick shaft 11. The fastening sleeve holds the pick 10 with the holding elements 21, whilst it is itself held in the holding attachment 43 of the pick holder 40 as a result of its prestressing. It thus enables rotation of the pick 10 about its center longitudinal axis, whilst movement in the direction of the center longitudinal axis is blocked.

A support element 30 is provided between the pick head 13 and the holding attachment 43 of the pick holder 40.

The pick holder 40 comprises a base part 41 onto which a plug-in attachment 42, which protrudes at the bottom, is integrally molded. The base part 41 additionally carries the integrally molded holding attachment 43 into which a pick receiving means 46 as a cylindrical bore is inserted. In this case, the pick receiving means 46 is realized as a through-bore which is open at its two long-side ends. A driving-out mandrel (not shown) of a driving-out tool can be inserted through the end of the pick receiving means 46 facing the plug-in attachment 42. The driving-out mandrel then acts on the free end of the pick shaft 11. The end of the pick receiving means 46 remote from the plug-in attachment 42 opens out in a cylindrical portion 44 of the holding attachment 43. Wear markings 45 are provided in the form of circumferential rings on the outer periphery of the holding attachment 43.

Figure 2:
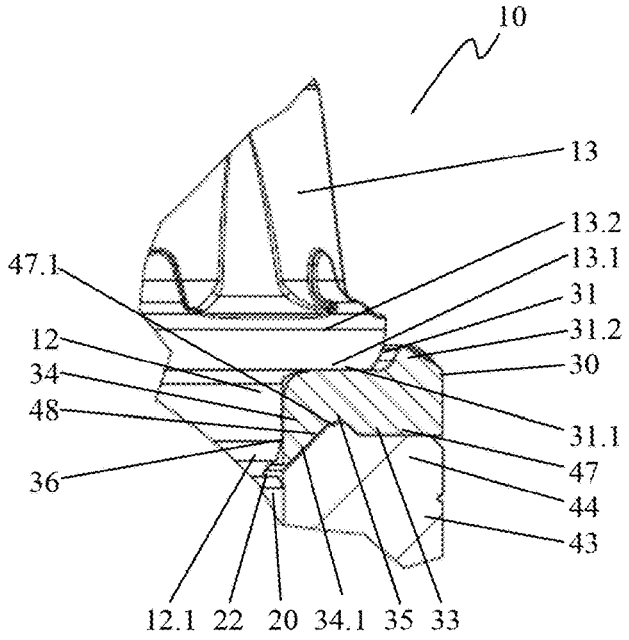
FIG. 2 shows a detail marked by way of II.

FIG. 2 shows a detail marked by way of II. in FIG. 1. The pick head 13 ends in the direction of the pick shaft 11 by way of a collar 13.2 which realizes a support surface 13.1. The support surface rests on a support surface 31.1 of the support element 30 which is formed by a recess 31 on the top surface of the support element 30. The support surface 31.1 is delimited correspondingly on the outside by an edge 31.2. On the side located opposite the support surface 31.1, the support element 30 comprises a seating surface 33 by way of which it rests on a wear surface 47 of the cylindrical portion 44 of the holding attachment 43. The support element 30 is designed in a substantially rotationally-symmetrical manner with respect to the center longitudinal axis of the pick 10. The seating surface 33 merges by means of an inner circumferential groove 35 into a centering surface 34.1 of a centering attachment 34 which extends at an angle with respect to the center longitudinal axis. As is illustrated clearly in FIG. 2, the centering attachment 34 of the support element 30 is inserted into a correspondingly formed centering receiving means 48 of the pick holder 40.

Along the center longitudinal axis, the support element 30 comprises a bore, by means of which a guide region 36 is formed for guiding the pick 10. In the mounting position, the centering portion 12 of the pick shaft 11 is associated with the guide region 36. In this way, a rotational bearing arrangement is created between the guide region 36 and the centering portion 12. In this connection, care must be taken to ensure that the outside diameter of the cylindrical centering portion 12 is matched in such a manner to the inside diameter of the guide region 36 that free rotatability is maintained between the support element 30 and the centering portion 12. The clearance between the two components should be chosen in such a manner that as small a lateral offset as possible is generated (transversely with respect to the center longitudinal axis of the pick (10)). In the exemplary embodiment, the diameters of the guide region 36 and of the centering portion remain the same over the complete axial length thereof. As a result, the edges and discontinuities which obstruct the rotatability of the pick 10 are also avoided in the region. As already shown in connection with FIG. 1, the centering portion 12 merges into a cylindrical pick shaft 11 after a tapering region 12.1.

The pick shaft 11 is held in the holding attachment 43 of the pick holder 40 by means of the fastening sleeve 20. At its upper end, the fastening sleeve 20 comprises a chamfer 22.

The pick 10 can be rotated about the center longitudinal axis during operation. The free rotatability ensures that the pick 10 wears in an even manner over its entire periphery. In this case, even the loosely placed support element 30 which is held by the centering portion 12 of the pick shaft 11 is rotated, as a result of which the rotatability of the pick 10 is improved further overall. As a result of the rotation and the high mechanical stress on the pick 10, the pick holder 40 is also worn, mainly in the upper portion 44 of the holding attachment 43. The wear surface 47 is abraded as a result of the stress. The wear present on the holding attachment 43 can be evaluated, in this case, by means of the wear markings 45 shown in FIG. 1.

As a result of the relative movement between the support element 30 and the holding attachment 43, the wear surface 47 of the holding attachment 43, which is flat when new, is worked into the groove 35 of the support element 30, as is shown in FIG. 2. As a result of a bead 47.1, which is realized in a such a manner corresponding to the contour of the groove 35, the support element 30 receives additional lateral guiding, which has a positive effect on the rotatability of the support element 30 and consequently on the pick 10. The centering surface 34.1 merges tangentially into the top surface of the groove 35 such that there are no edges which obstruct the rotatability. In a corresponding manner, the top surface of the groove 35 merges into the seating surface 33 by means of a rounding portion without sharp edges. With its radially outer surface portion, the groove 35 counters forces which act radially inward onto the support element 30. Radially outwardly directed forces are countered by the radially inner surface portion. The force which has to be received by the centering surface 34.1 is reduced as a result, which leads in the region to reduced surface pressure and correspondingly to reduced wear. Over and above this, the support also counters a tumbling movement in the disk plane of the support element 30, which brings about a significant reduction in wear on the pick holder 40. In addition, the groove, with its counterpart worked out of the wear surface 47, serves as a labyrinth-like seal. Waste material which passes between the seating surface 33 and the wear surface 47 is prevented from penetrating further by the seal and thus does not pass or only passes to a reduced extent into the region of the pick shaft 11.

Figure 3:
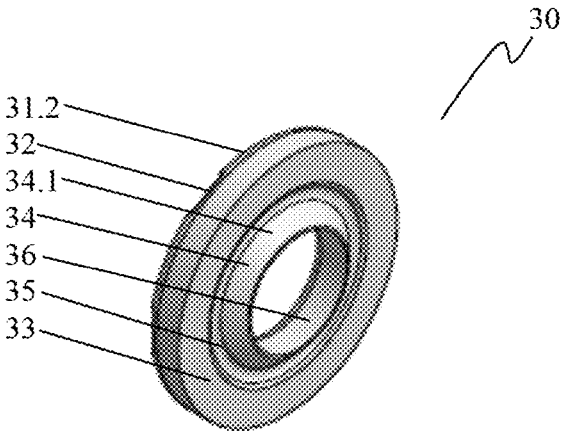
FIG. 3 shows a perspective view of a support element shown in FIGS. 1 to 2.
Figure 4:
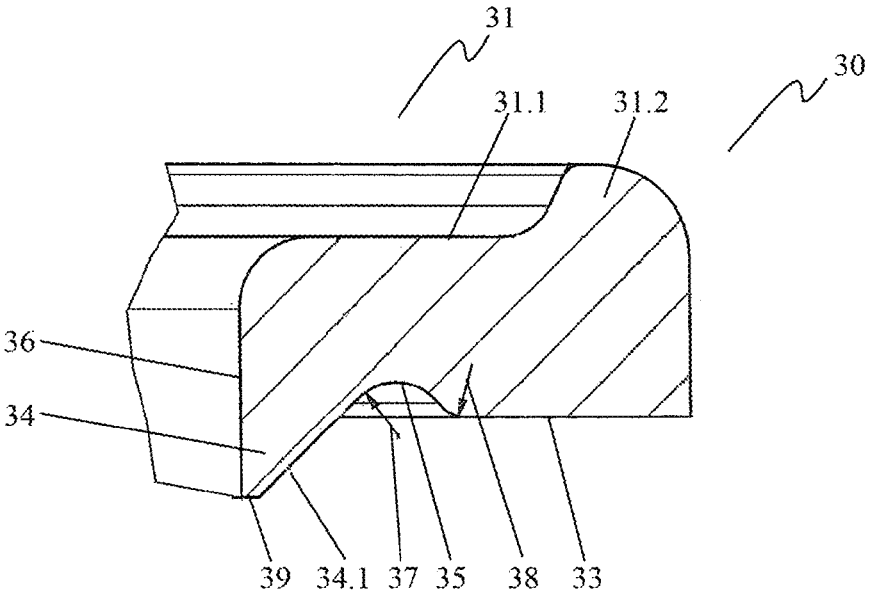
FIG. 4 shows a lateral sectional representation of a cutout of a support element shown in FIGS. 1 to 3.

The support element 30 is shown again in FIGS. 3 and 4. As the representations illustrate, the seating surface 33 merges into the groove 35 which is arranged circumferentially with respect to a central bore. The centering attachment 34, which is also arranged circumferentially with respect to the central bore, with the centering surface 34.1 which extends at an angle, follows the groove 35. The top surface of the central bore forms the guide region 36. The centering attachment 34 ends with a circumferential web 39.

Recesses 32, which are realized as radially extending grooves, are provided in the edge 31.2 realized on the top side of the support element 30. It can be seen from the representation according to FIG. 3 that, up to the recesses 32, the support element 30 is realized in a rotationally symmetrical manner with respect to its center longitudinal axis.

FIG. 4 shows a lateral sectional representation of a cutout of a support element shown in FIGS. 1 to 3. It comprises on its top side the bowl-shaped recess 31 which is delimited on the outside by the rounded edge 31.2. The recess 31 forms the support surface 31.1 which merges into the guide region 36 by means of a rounding. The support element 30, in reverse to the recess 31, comprises the seating surface 33 which is arranged in a plane-parallel manner with respect to the support surface 31.1. The seating surface 33 merges into the centering shoulder 34 by means of the groove 35. The centering surface 34.1 of the centering attachment 34, which connects to the groove 35, is arranged at an angle with respect to the guide region 36 which is shown by a central bore. The centering attachment 31 ends by means of the web 39 which connects the centering surface 34.1 and the guide region 36.

In the exemplary embodiment shown, the depth of the groove 35 in relation to the seating surface 34 is one millimeter with a radius 37 of 1.5 mm marked by an arrow. The thickness of the support element 30 is five millimeters between the support surface 31.1 and the seating surface 33. As a result, a sufficient material thickness is ensured between the groove 35 and the support surface 31.1. A second radius 38 of the rounding portion between the groove 35 and the seating surface 33 is one millimeter, the rounding portion merging tangentially into the top surface of the groove 35 and of the seating surface 33. The width of the web in the exemplary embodiment is 0.5 mm.

The invention claimed is:

1. A pick comprising a pick head, a pick shaft, and a support element that includes a bottom surface and a protruding centering attachment on the bottom surface, wherein the centering attachment includes a centering surface that extends at an angle with respect to a center longitudinal axis of the pick and merges into a seating surface, wherein a circumferential groove is arranged in a transition region from the centering surface to the seating surface, and wherein the depth of the groove in relation to the seating surface is greater than or equal to 0.3 mm.

2. The pick as claimed in claim 1, wherein the centering surface merges tangentially into a top surface of the groove.

3. The pick as claimed in claim 1, wherein the groove has a depth between 0.3 mm and 2 mm in relation to the seating surface.

4. The pick as claimed in claim 3, wherein the groove has a depth between 0.5 mm and 1.5 mm.

5. The pick as claimed in claim 1, wherein a ratio of a thickness of a part of the support element receiving the groove to the depth of the groove is at least 2 to 1 and/or wherein a material thickness between the groove and a support surface located opposite the seating surface is at least 2 mm.

6. The pick as claimed in claim 1, wherein the support element has a diameter between 38 mm and 95 mm.

7. The pick as claimed in claim 1, wherein the groove comprises a rounded contour, and wherein a radius of the rounded contour lies within a range of between 0.5 mm and 6 mm.

8. The pick as claimed in claim 7, wherein the rounded contour is circular.

9. The pick as claimed in claim 7, wherein the radius of the rounded contour is 1.5 mm.

10. The pick as claimed in claim 1, wherein a top surface of the groove is carried over a rounding portion or a chamfer into a top surface of the seating surface.

11. The pick as claimed in claim 10, wherein the rounding portion is formed by a circular arc portion with a radius within a range of between 0.2 mm and 25 mm.

12. The pick as claimed in claim 11, wherein the radius is 1.0 mm.

13. The pick as claimed in claim 10, wherein the rounding portion merges tangentially into the seating surface.

14. The pick as claimed in claim 1, wherein the support element forms a guide region which is formed by a bore which extends in the direction of the center longitudinal axis of the pick, wherein the guide region is carried over a circumferential web into the centering surface, and wherein the web has a width within a range between 0.1 mm and 2.0 mm.

15. The pick as claimed in claim 14, wherein the web has a width of 0.5 mm.

16. The pick as claimed in claim 1, wherein the pick is a round shaft pick.

* * * * *